US012152367B2

(12) United States Patent
Gentle et al.

(10) Patent No.: US 12,152,367 B2
(45) Date of Patent: Nov. 26, 2024

(54) CONTROL SYSTEM FOR A GRADING MACHINE

(71) Applicant: Caterpillar Inc., Peoria, IL (US)

(72) Inventors: Michael C. Gentle, Maroa, IL (US); Ethan M. Tevis, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 425 days.

(21) Appl. No.: 17/122,886

(22) Filed: Dec. 15, 2020

(65) Prior Publication Data

US 2022/0186463 A1 Jun. 16, 2022

(51) Int. Cl.
*E02F 3/84* (2006.01)
*E02F 3/76* (2006.01)

(52) U.S. Cl.
CPC ..... *E02F 3/844* (2013.01); *E02F 3/7636* (2013.01); *E02F 3/7654* (2013.01); *E02F 3/845* (2013.01)

(58) Field of Classification Search
CPC ..... E02F 3/844; E02F 3/7636; E02F 3/845; E02F 3/7654
See application file for complete search history.

(56) References Cited

U.S. PATENT DOCUMENTS

| | | | | |
|---|---|---|---|---|
| 5,875,854 | A * | 3/1999 | Yamamoto et al. | E02F 9/2029 701/50 |
| 7,058,495 | B2 | 6/2006 | Budde et al. | |
| 8,473,166 | B2 | 6/2013 | Zhdanov et al. | |
| 8,639,416 | B2 | 1/2014 | Jones et al. | |
| 9,045,871 | B2 | 6/2015 | Graham et al. | |
| 9,332,691 | B2 * | 5/2016 | Fukuda et al. | G06F 3/04847 |
| 9,885,169 | B2 * | 2/2018 | Sharpe et al. | E02F 3/6454 |
| 2011/0213529 | A1 * | 9/2011 | Krause et al. | E02F 3/431 701/50 |
| 2018/0373257 | A1 * | 12/2018 | Runde et al. | A01B 69/007 |
| 2019/0093319 | A1 | 3/2019 | Elkins | |
| 2019/0382983 | A1 | 12/2019 | Gentle et al. | |
| 2020/0123735 | A1 * | 4/2020 | Stotlar | E02F 3/841 |
| 2020/0173141 | A1 * | 6/2020 | Gentle et al. | E02F 3/765 |

* cited by examiner

*Primary Examiner* — Thomas B Will
*Assistant Examiner* — Joel F. Mitchell

(57) ABSTRACT

A grading machine includes a machine body, a grading blade, and a control system. The control system is configured to automatically set at least one machine parameter of the grading blade based on a determined location of the grading machine and automatically set a mode of operation of the grading machine based on a determined location of the grading machine.

17 Claims, 6 Drawing Sheets

CONTROL SYSTEM FOR A GRADING MACHINE

TECHNICAL FIELD

The present disclosure relates generally to a grading machine, and more particularly, to a control system for a grading machine.

BACKGROUND

The present disclosure relates to mobile machines that are used in grading. Grading machines are typically used to cut, spread, or level material that forms a ground surface. To perform such earth sculpting tasks, grading machines include a blade, also referred to as a moldboard or implement. The blade moves relatively small quantities of earth from side to side, in comparison to a bulldozer or other machine that moves larger quantities of earth. Grading machines are frequently used to form a variety of final earth arrangements, which often require the blade to be positioned in different positions and/or orientations depending on the sculpting task. The different blade positions may include adjustments to the blade height, blade cutting angle, blade pitch, blade sideshift, and drawbar sideshift. Accordingly, grading machines may include several operator controls to manipulate various portions of the machine. These controls may further include preset positions based on stored settings within the control system. Positioning and orienting the blade of a motor grader is a complex and time consuming task that may require a great deal of experience and/or expertise.

U.S. Pat. No. 7,058,495 B2, issued to Budde et al. ("the '495 patent"), describes an implement positioning system that automatically controls the position of a work implement to improve the efficiency of a dozing type work machine in performing a repeat pass work task. In particular, the implement positioning system may move the work implement to a preset elevated position when the work machine has completed a work pass and is moving into position for another work pass. The implement positioning system may move work implement to a preset lowered, or working, position when the work machine is positioned to start another work pass.

The system of the present disclosure may solve one or more of the problems in the art. The scope of the current disclosure, however, is defined by the attached claims, and not by the ability to solve any specific problem.

SUMMARY

In accordance with one aspect of the present disclosure, a grading machine includes a machine body, a grading blade, and a control system configured to automatically set at least one machine parameter of the grading blade based on a determined location of the grading machine.

In accordance with another aspect of the present disclosure, a method of operating a grading machine having a machine body and a grading blade is provided. The method includes determining a location of the machine, automatically setting at least one machine parameter of the grading blade based on a stored machine parameter of the grading blade associated with the determined location of the machine, and operating the machine with the automatically set at least one machine parameter of the grading.

In accordance with another aspect disclosure, a method of operating a grading machine having a machine body and a grading blade is provided. The method includes storing at least one machine parameter of the grading blade in association with a location of the machine, automatically setting at least one machine parameter of the grading blade based on the stored at least one machine parameter of the grading blade and a determined location of the machine, and operating the machine with the automatically set at least one machine parameter of the grading blade is provided.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces or earthen materials that may be worked in construction procedures (e.g., gravel, clay, sand, dirt, etc.) and/or can be cut, spread, sculpted, smoothed, leveled, graded, or otherwise treated. In this disclosure, unless stated otherwise, relative terms, such as, for example, "about," "substantially," and "approximately" are used to indicate a possible variation of ±10% in a stated value. Although the current disclosure is described with reference to a motor grader, this is only exemplary. In general, the current disclosure can be applied to any machine, such as, for example, a plow, scraper, dozer, or another grading-type machine.

Motor Grader Components

Figure 1:
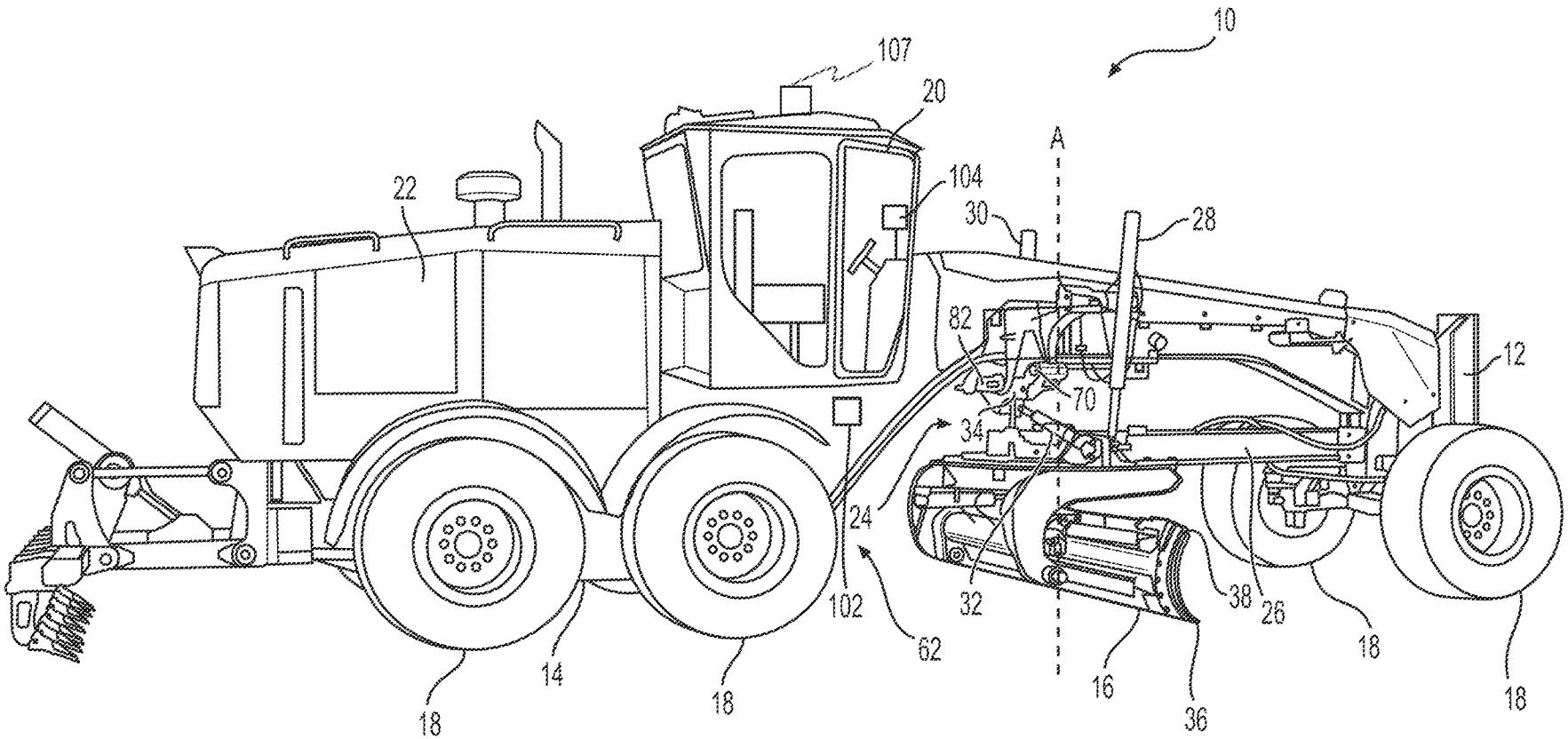
FIG. 1 is an illustration of an exemplary grading machine, according to aspects of this disclosure.

FIG. 1 illustrates a perspective view of an exemplary motor grader machine 10 (hereinafter "motor grader"), according to the present disclosure. Motor grader 10 includes a front frame 12, a rear frame 14, and a blade 16. Front frame 12 and rear frame 14 are supported by wheels 18. An operator cab 20 may be mounted above a coupling of front frame 12 and rear frame 14, and may include various operator controls 104, including, for example, joysticks, pedals, buttons, switches, information displays, touch screens, etc., (hereinafter referred to as "operator interfaces 104"). The operator interfaces 104 may be used to monitor and control the various components of the motor grader 10. Rear frame 14 also includes an engine 22 to drive or power the motor grader 10. Blade 16, sometimes referred to as a moldboard, is used to cut, spread, or level (collectively "sculpt") earth or other material traversed by machine 10. As shown in greater detail in FIGS. 2A and 2B, blade 16 is mounted on a linkage assembly, shown generally at 24. Linkage assembly 24 allows blade 16 to be moved to a variety of different positions and orientations relative to motor grader 10, and thus sculpt the traversed material in different ways.

Additionally, a controller 102 may be receive information from sensors and user interfaces 104, and send information (i.e., commands) to various components of the motor grader 10. Controller may also be in communication with a machine location sensor 107 to determine a location of the motor grader 10. In one aspect, motor grader 10 may be an electrohydraulic motor grader, and controller 102 may control one or more electrical actuators, switches or valves in order to control one or more hydraulic cylinders or electrical elements in order to operate motor grader 10.

Starting at the front of the motor grader 10 and working rearward toward the blade 16, linkage assembly 24 includes a drawbar 26. Drawbar 26 is pivotably mounted to the front frame 12 with a ball joint (not shown). The position of drawbar 26 may be controlled by hydraulic cylinders, including, for example, a right lift cylinder 28, a left lift cylinder 30, a centershift cylinder 32, and a linkbar 34. A height of blade 16 with respect to the surface being traversed below motor grader 10, commonly referred to as blade height, may be primarily controlled and/or adjusted with right lift cylinder 28 and left lift cylinder 30. Right lift cylinder 28 and left lift cylinder 30 may be controlled independently and, thus, may be used to tilt a bottom of blade 16, which includes a bottom cutting edge 36 and a top edge 38. Based on the positions of right lift cylinder 28 and left lift cylinder 30, cutting edge 36 may be tilted relative to the traversed material, so lift cylinders 28 and 30 may control a blade tilt. One or more blade tilt sensors 40 (e.g., inertial measurement units), as seen in FIG. 2A, may be mounted on or otherwise coupled to blade 16 in order to measure a vertical tilt of blade 16 from one end to another end relative to front frame 12.

Centershift cylinder 32 and linkbar 34 may be used primarily to shift a lateral position of drawbar 26, and any components mounted to drawbar 26, relative to front frame 12. This lateral shifting is commonly referred to as drawbar centershift. As shown in more detail in FIG. 2C, centershift cylinder 32 may include a cylinder end 78 pivotably coupled to drawbar 26, and a rod end 80 pivotably coupled to linkbar 34. Linkbar 34 may include a plurality of position holes 70 for selectively positioning linkbar 34 to the left or right to allow for further shifting of drawbar 26 to a left or right side of the motor grader 10 by centershift cylinder 32. One or more drawbar centershift sensors 42 (e.g., inertial measurement units, linear position sensors on one or more cylinders, etc.) may be mounted on or otherwise coupled to centershift cylinder 32 (FIGS. 2A and 2B) or may be mounted on or otherwise coupled to drawbar 26 in order to measure a position of drawbar 26 relative to front frame 12. Furthermore, although not shown, each of right lift cylinder 28, left lift cylinder 30, and centershift cylinder 32 may include one or more position sensors operably coupled to the respective moving cylinders or rods to measure and communicate the extension or position of each cylinder, and thus a corresponding position or orientation of drawbar 26 and blade 16.

Figure 2A:
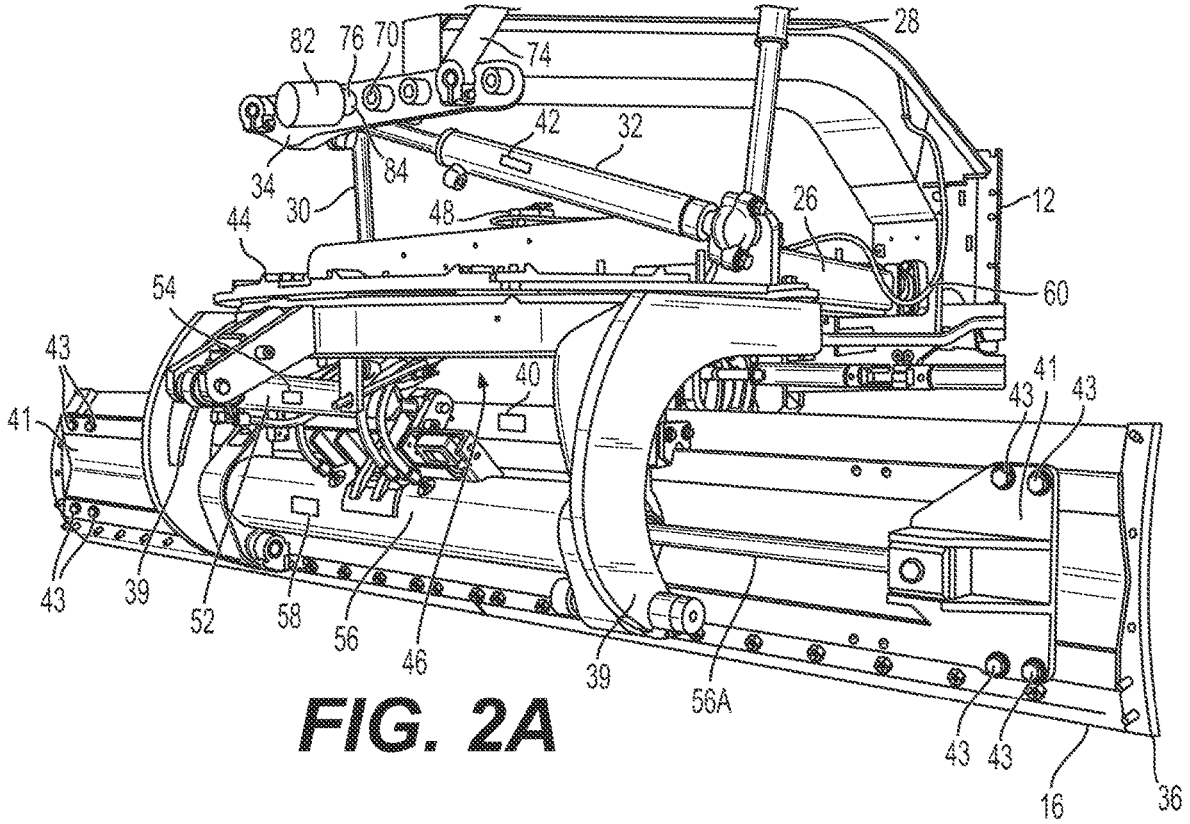
FIG. 2A is a rear perspective view of a grading portion of the grading machine of FIG. 1, according to aspects of this disclosure.
Figure 2B:
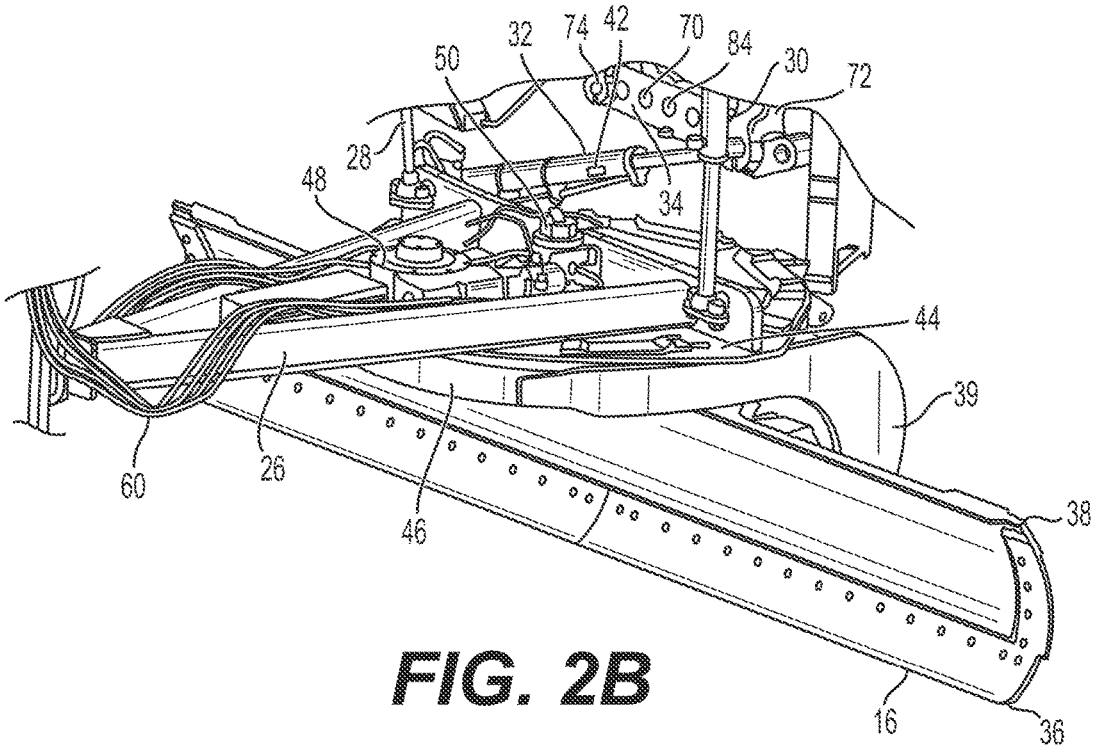
FIG. 2B is a front perspective view of the grading portion of the grading machine of FIG. 1, according to aspects of this disclosure.

Drawbar 26 includes a large, flat plate, commonly referred to as a yoke plate 44, as shown in FIGS. 2A and 2B. Beneath yoke plate 44 is a large gear, commonly referred to as a circle 46. Circle 46 may be rotated by a hydraulic motor, for example by a circle drive motor 48, as shown in FIG. 2B. The rotation of circle 46 by circle drive motor 48, commonly referred to as circle angle, pivots blade 16 about an axis A (FIG. 1) fixed to drawbar 24 to establish a blade cutting angle. The blade cutting angle is defined as the angle of blade 16 relative to front frame 12, and the blade cutting angle may be controlled by a combination of the position of circle 46 and the position of drawbar 26.

Circle 46 and blade 16 may be coupled via support arms 39 and support plate 41. Blade 16 may be coupled to support plate 41 by a plurality of removable screws 43, for example, in order to replace blade 16 or a portion of blade 16. Circle 46 and blade 16 may be rotated up to approximately 75 degrees clockwise or counterclockwise relative to front frame 12 about axis A. At a 0 degree blade cutting angle, blade 16 is arranged at a right angle to the front frame 12. Additionally, a circle angle sensor 50, for example, a rotary sensor, inertial measurement unit, etc., may be positioned on circle 46 to measure an angular rotation of circle 46, and thus an angle of blade 16. In one aspect, circle angle sensor 50 may be mounted in a centered position on circle 46. In another aspect, circle angle sensor 50 may be mounted in an off-centered position on circle 46, and circle angle sensor 50 or other internal components of motor grader 10 may be used to calculate the position of circle 46 and blade 16 based on a compensation or correction to account for the off-centered position of circle angle sensor 50. For example, circle 46 and blade 16 may be positioned at various angles in order to perform various grading operations, as discussed below with respect to FIGS. 4 and 5.

Blade 16 is pivotably mounted to circle 46, for example, with a portion of blade 16 being movable in a direction parallel to the surface being traversed and in a direction transverse to cutting edge 36 of blade 16. A blade pitch cylinder 52 may be coupled to top edge 38 of blade 16, and may be used to control or adjust a pitch of top edge 38 forward or backward. In other words, blade pitch cylinder 52 may be used to tip top edge 38 of blade 16 ahead of or behind cutting edge 36 of blade 16. The position of top edge 38 of blade 16 relative to cutting edge 36 of blade 16 is commonly referred to as blade pitch. In one aspect, blade pitch cylinder 52 may control a blade pitch of blade 16 within a range of 45 degrees, for example, from a position of negative five degrees with top edge 38 behind cutting edge 36, to a position of positive 40 degrees with top edge 38 ahead of cutting edge 36. Additionally, a blade pitch sensor 54, for example, an inertial measurement unit, may be positioned on blade 16, for example, on top edge 38. In other aspects, one or more blade pitch sensors 54 may include a rotary sensor on blade 16 or a linear displacement sensor coupled to blade pitch cylinder 52. Blade pitch sensor 54 may detect the blade pitch, and blade 16 may be positioned in various blade pitches in order to perform various grading operations.

Blade 16 may be mounted to drawbar 26 and/or circle 46 via a sliding joint. For example, a sideshift cylinder 56 and sideshift rod 56A may control the position of blade 16 relative to drawbar 26 and/or circle 46. Sideshift cylinder 56 may be positioned between support arms 39, and support rod 56A may be coupled to support plate 41. Thus, driving sideshift rod 56A relative to sideshift cylinder 56 slides or shifts blade 16 from side to side relative to drawbar 26 and circle 46. This side to side shift is commonly referred to as blade sideshift. Additionally, a blade sideshift sensor 58 (e.g., a linear displacement sensor) may be coupled to sideshift cylinder 56 to measure a position of sideshift cylinder 56, and thus of blade 16, relative to drawbar 26 and circle 46. For example, sideshift cylinder 56 and blade 16 may be positioned at various sideshift positions in order to perform various grading operations.

Figure 2C:
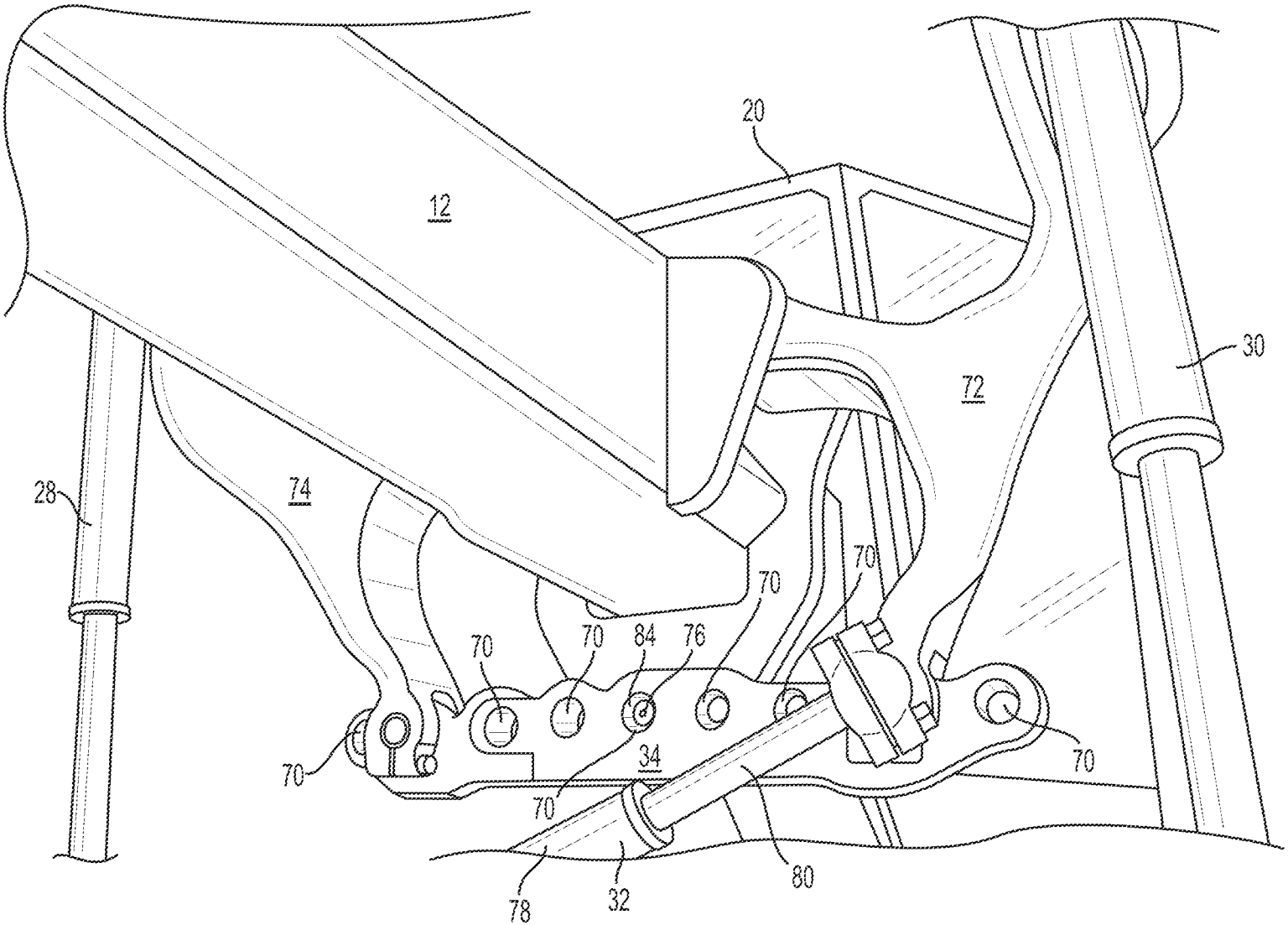
FIG. 2C illustrates an enlarged view of the linkbar system of the grading machine of FIG. 1, according to aspects of this disclosure.

As shown in FIGS. 1 and 2A-2C, linkbar 34 is a generally straight member that includes a plurality of position holes 70 extending therethrough. Linkbar 34 is secured to both front frame 12 and drawbar 26. For example, as best shown in FIG. 2C, linkbar 34 may be secured to front frame 12 by left and right lift cylinder arms 72, 74 and a linkbar pin 76. Left and right lift cylinder arms 72, 74 are fixedly and pivotably secured to both the front frame 12 and to the linkbar 34 at outer position holes 70 of linkbar 34. Linkbar pin 76 extends through one of the position holes 70 of linkbar 34 to form a fulcrum for linkbar 34. As noted above, centershift cylinder 32 may couple linkbar 34 to drawbar 26 by a cylinder end 78 pivotably coupled to drawbar 26, and a rod end 80 of centershift cylinder 32 pivotably coupled to an outer position hole 70 of linkbar 34.

Linkbar pin 76 is controllable by a pin actuator 82 (FIG. 2A), such as a hydraulic or solenoid actuator, to extend and retract so as to allow for shifting of the fulcrum of the linkbar 34 to the left or right via engaging the linkbar pin 76 into different position holes 70 of linkbar 34. For example, during more standard motor grader operations where the blade 16 is generally centrally located under the motor grader 10, linkbar pin 76 may extend into the center-most position hole 84 of the linkbar 34 to form a centrally located fulcrum of linkbar 34. However, some modes of motor grader 10 may require the blade 16 to extend significantly to one side of the motor grader 10. In these situations, (1) the linkbar pin 76 can be retracted out from the centrally located position hole 84, (2) the linkbar 34 can be shifted to a side by movement of the centershift cylinder 32 and in some instances movement of lift cylinders 28, 30, and (3) the linkbar pin 76 can be extended into a new a new position hole 70 that is to one side of the centrally located position hole 84. The position of the linkbar 34, corresponding to which position hole the linkbar pin 76 is engaging, can be determined by any conventional linkbar position sensor 86, such as an IMU as discussed herein. As will be discussed in more detail below, this side shifting of the linkbar 34 can be done automatically at the request of the operator or automatically as part of an automatic mode movement.

Additionally, front frame 12 and rear frame 14 may be articulated relative to one another during operation of motor grader 10 at a pivotable coupling or linkage 62, for example, below cab 20. Although not shown, articulation cylinders may be mounted on the left and right sides of rear frame 14, and may be used to articulate (or rotate) front frame 12. With front frame 12 and rear frame 14 aligned, as shown in FIG. 1, motor grader 10 is positioned in a neutral or zero articulation angle. Various other articulation angles may be used when grading inclined or banked surfaces or when forming inclined or banked surfaces (i.e., ditches). User interfaces 104 may allow the operator to select one or more predetermined articulation positions, and controller 102 may signal one or more actuators coupled to the articulation cylinders to position the articulation cylinders, and thus position front frame 12 relative to rear frame 14.

Motor Grader Control

The various components of motor grader 10 discussed above may be adjusted simultaneously or in combination in order for motor grader 10 to perform various operations or functions. For example, one or more of right lift cylinder 28, left lift cylinder 30, centershift cylinder 32, linkbar 34, circle drive motor 48, blade pitch cylinder 52, sideshift cylinder 56, and articulation cylinders may be actuated or shifted in order to position one or more of blade 16, drawbar 26, and frames 12, 14 for a desired motor grader operation or function.

As shown in FIGS. 1, 2A, and 2B, motor grader 10 may include a plurality of hydraulic lines 60 in order to control the hydraulic cylinders. Motor grader 10 may include a hydraulic pump (not shown). The hydraulic pump may supply high pressure hydraulic fluid through one or more of hydraulic lines 60 to one or more of the hydraulic cylinders. A low pilot pressure may be provided by a hydraulic pressure reducing valve, which can receive the high pressure hydraulic fluid and supply low pilot pressure to each hydraulic cylinder. Additionally, each hydraulic cylinder may include an electrical solenoid and one or more hydraulic valves. The solenoid may receive one or more signals from controller 102 to control and position each hydraulic cylinder by configuring the flow of hydraulic fluid through the valves. The delivery of the hydraulic fluid may be controlled by controller 102, for example, via one or more operator commands via user interfaces 104.

Figure 3:
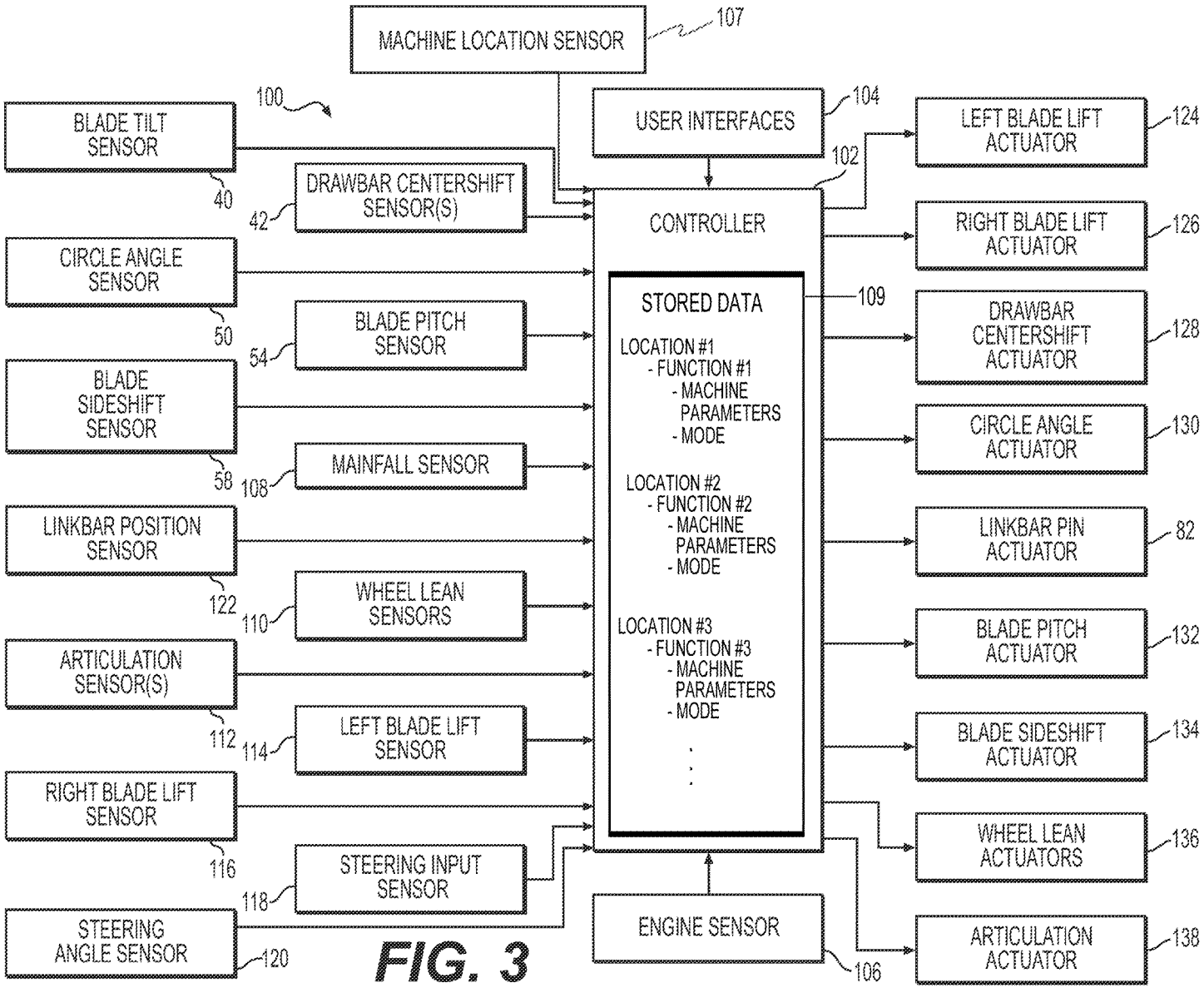
FIG. 3 illustrates a schematic view of a portion of a control system for the exemplary grading machine of FIG. 1, according to aspects of this disclosure.

FIG. 3 illustrates an exemplary schematic view of a control system 100 of motor grader 10. Control system 100 may include the one or more controllers 102 in communication with a plurality of sensors, user interfaces 104, actuators, and other controllable components of motor grader 10. As will be explained in more detail below, control system 100 may be configured to send, receive, and store data for monitoring and controlling aspects of motor grader 10.

As shown in FIG. 3, and as discussed above, control system 100 may include blade tilt sensor 40, drawbar centershift sensor 42, circle angle sensor 50, blade pitch sensor 54, and sideshift sensor 58. Additionally, control system 100 may include a mainfall sensor 108 that measures an angle or pitch of motor grader 10. Control system 100 may include one or more wheel lean sensors 110 coupled to wheels 18 or other portions of the wheels to measure a wheel lean of one or more wheels 18. Control system 100 may include one or more articulation sensors 112 coupled to front frame 12 and/or rear frame 14 to measure an articulation between front frame 12 and rear frame 14. Furthermore, control system 100 may include one or more left blade lift sensors 114 and one or more right blade lift sensors 116. Left and right blade lift sensors 114 and 116 are respectively coupled to left lift cylinder 30 and right lift cylinder 28 (FIG. 1), and may confirm or otherwise be related to a measured blade tilt, for example, via blade tilt sensor 40. It is understood that each of these sensors and any other sensor discussed herein may be an inertial measurement unit mounted on one or more components, an angular position or rotary sensor mounted on one or more components, a linear displacement sensor coupled to the moving cylinder or rod of a hydraulic sensor, or any other suitable sensor.

In addition, control system 100 may include a steering input sensor 118, which may be coupled to a steering wheel, joystick, or other control mechanism for steering motor grader 10. Based on the sensed input via steering input sensor 118, controller 102 may signal one or more actuators to control the steering, articulation, wheel lean, etc. of motor grader 10. Control system 100 may also include a steering angle sensor 120, which may measure an actual steering angle or direction of motor grader 10.

As noted above, control system 100 may also include a linkbar position sensor 122 that senses the position of the linkbar 34, and in particular, the current position of the linkbar 34 corresponding to which position hole 70 currently receives the linkbar pin 76. Controller 102 may also be coupled to linkbar pin actuator 82 that controls the extension and retraction of the linkbar pin 76 during side shifting of the linkbar 34.

Finally, control system 100 may include one or more machine location sensors 107 for receiving machine location data. Machine location sensor 107 may include any type of sensor for sensing, measuring, calculating, or otherwise determining a geographical position (e.g., a geolocation) of motor grader 10, and communicating that information to controller 102. For example, machine position sensor 107 may include a global positioning system (GPS) receiver in communication with a global navigation satellite system (GNSS) for receiving a geolocation from the GNSS. Machine position sensor 107 may include a high accuracy system, such as real-time kinematic (RTK) positioning, for precisely calculating geographic locations of the machine position sensor 107 within sub-meter to centimeter accuracy. It is understood that machine location sensor 107 may be positioned on motor grader 10 in any location.

Based on information from the aforementioned sensors, and as mentioned above, controller 102 may be in communication with a plurality of actuators. Each of the actuators discussed herein may be a control valve for the respective hydraulic cylinder, an electric actuator, or any suitable actuator. Moreover, the actuators may include various combinations of actuators. For example, controller 102 may be in communication with one or more left blade lift actuators 124 and one or more right blade lift actuators 126. Left and right blade lift actuators 124 and 126 control the positions of left and right lift cylinder 28 and 30, and thus control an angle of blade 16. Moreover, controller 102 may be in communication with one or more drawbar centershift actuators 128, which may control a position of centershift cylinder 32.

Controller 102 may be in communication with a circle angle actuator 130, which may control circle drive motor 48. Controller 102 may also be in communication with a blade pitch actuator 132, which may control blade pitch cylinder 52. In addition, controller 102 may be in communication with a blade sideshift actuator 134, which may control sideshift cylinder 56.

Controller 102 may further be in communication with one or more wheel lean actuators 136, which may control a wheel lean of wheels 18 coupled to front frame 12 and rear frame 14. Controller 102 may also be in communication with an articulation actuator 138, which may control one or more articulable connections between front frame 12 and rear frame 14 to control the articulation of motor grader 10.

Controller 102 may be in any conventional form and may include, for example, hardware, software, and firmware for executing various instructions or functions, including those described in connection with the method of FIGS. 4 and 5. For example, controller 102 may include one or more processors, memory, communication systems, clocks, and/or other appropriate hardware. Controller 102 may be, for example, a single or multi-core processor, a digital signal processor, microcontroller, a general purpose central processing unit (CPU), and/or other conventional processor or processing/controlling circuit or controller. The memory may include, for example, read-only memory (ROM), random access memory (RAM), flash or other removable memory, or any other appropriate and conventional memory. Communication systems associated with controller 102 (e.g., between controller 102 and various the various sensors, actuators, and other components of machine 10) may include, for example, any conventional wired and/or wireless communication systems such as Ethernet, Bluetooth, and/or wireless local area network (WLAN) type systems.

As will be described in more detail below in connection with the methods of FIGS. 4 and 5, the memory of controller 102 may include a memory 109 storing various information, including machine location data associated with a function of motor grader 10. The function data may include, for example, a marking pass function, a cutting pass function, a shoulder cleanup pass function, a ditch backslope pass function, and/or a finish shoulder pass function. Machine parameters may be stored in memory 109 in association with a particular function of motor grader 10. The machine parameters may be settings for any or all of the actuators and or other controllable components of the motor grader 10. The machine parameters may include, for example, settings associated with the position of the blade 16, such as settings for blade lift position, drawbar centershift position, blade sideshift position, or blade pitch position. Mode of operation settings may also be stored in memory 109 in association with a particular function of motor grader 10. Mode settings may include, for example, at least one of differential lock, auto articulation, bounce reduction, ride control, engine speed, or a gear of the drivetrain of the grading machine.

Although only a number of sensors, actuators, and inputs are discussed with respect to FIG. 3, this disclosure is not so limited. Rather, control system 100 may include additional sensors and actuators in communication with controller 102 in addition to the sensors and actuators mentioned above in order to measure and control various aspects of motor grader 10. Furthermore, based on the information from the plurality of sensors and/or based on operator interfaces 104, controller 102 may automatically signal one or more the actuators to control various portions of motor grader 10.

Location-Based Machine Function Recall

Figure 4:
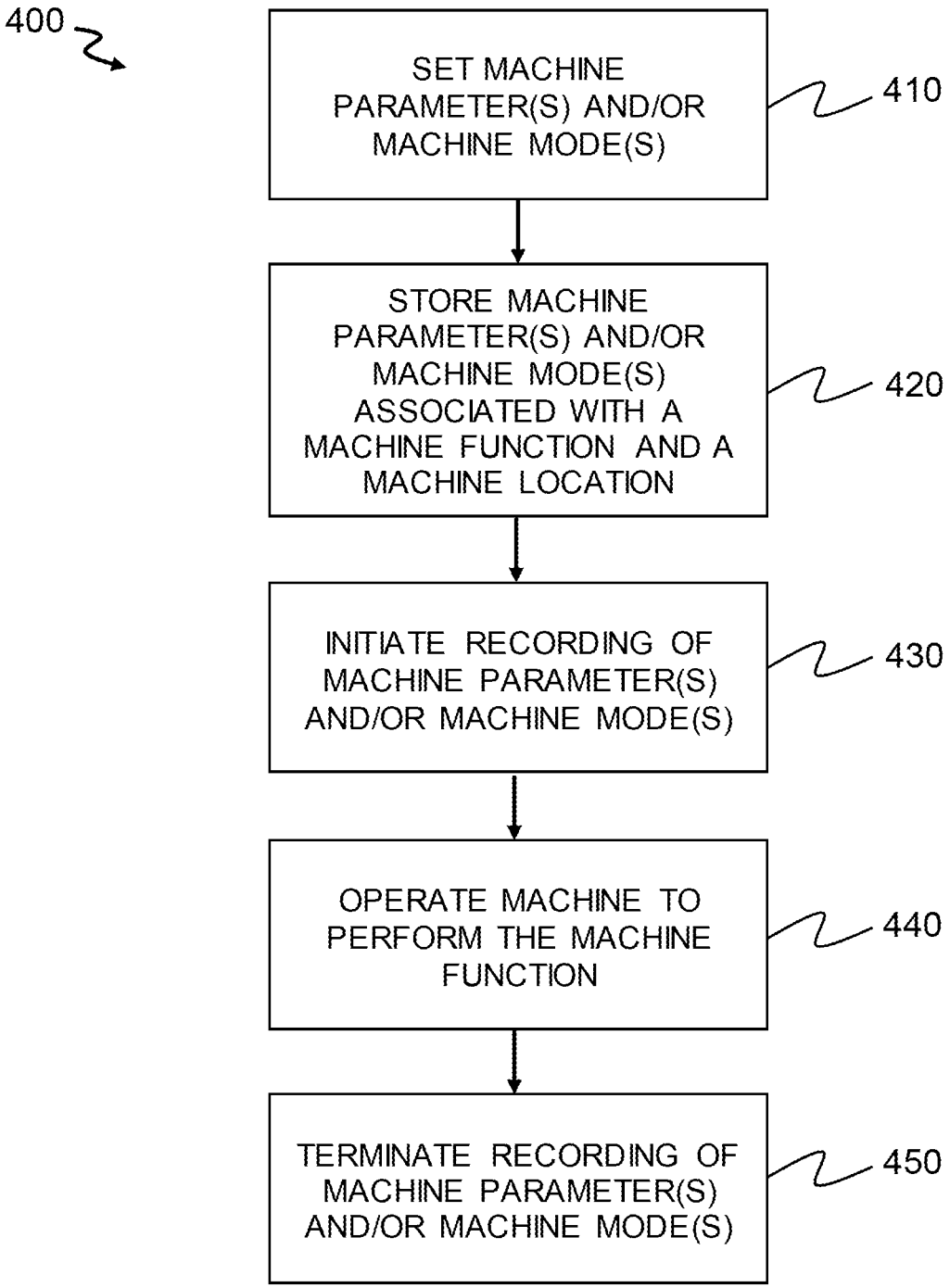
FIGS. 4 and 5 provide flow charts depicting exemplary methods for controlling the grading machine of FIG. 1.
Figure 5:
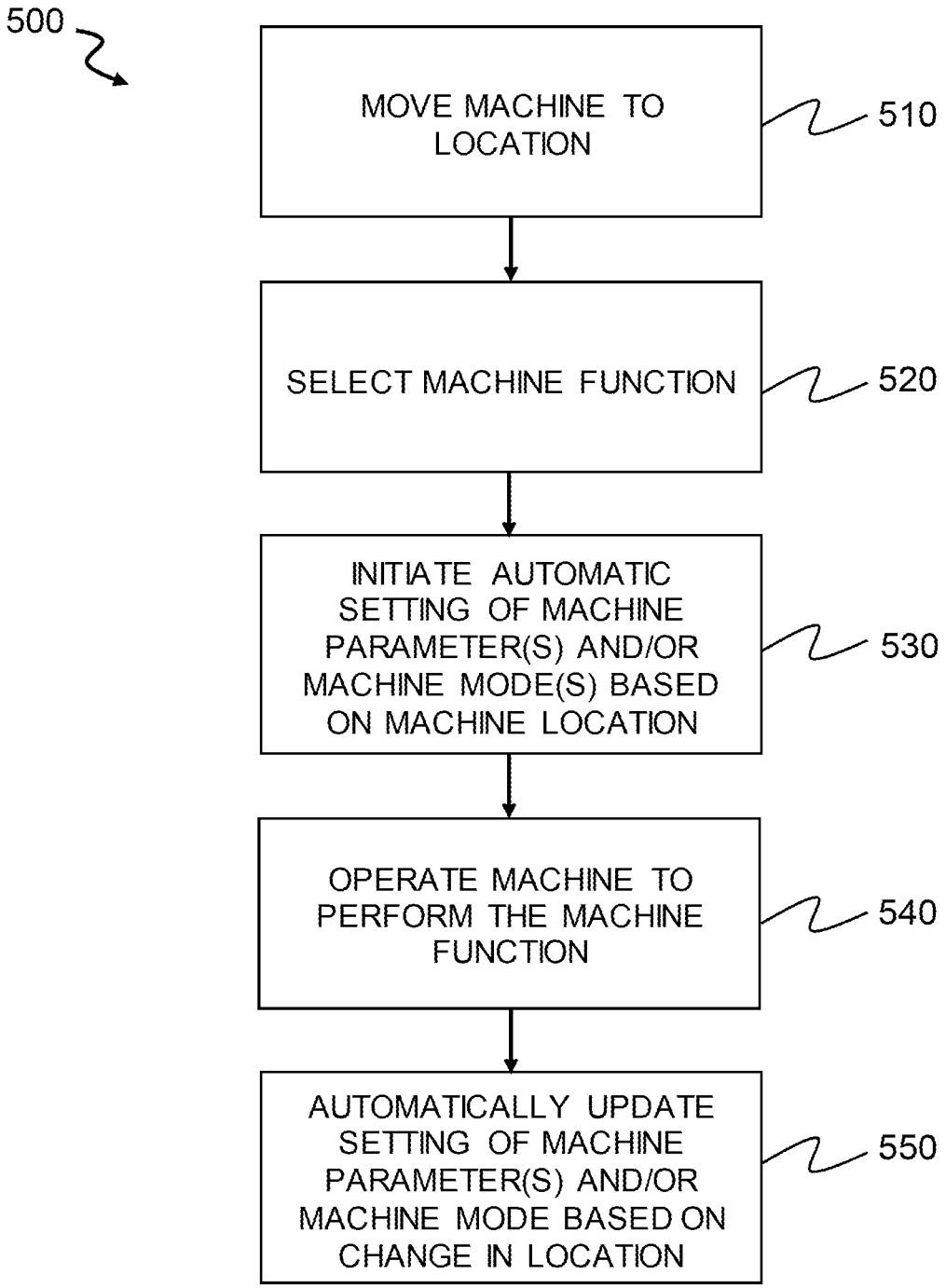

Reference will now be made to FIGS. 4 and 5 and a method for location-based machine function recalling of stored machine parameters and operating modes of motor grader 10. FIG. 4 illustrates a method 400 of storing machine parameters and/or machine modes associated with machine functions of motor grader 10 and in association with a location of the motor grader 10. Method 400 may include, for example, the steps of setting machine parameters and/or modes of the motor grader 10 (step 410); storing the set machine parameters and/or machine modes in association with a machine function and in association with a location of the motor grader 10 (step 420); initiating a recording of the machine parameters and/or machine modes (step 430); operating the motor grader 10 to perform the machine function (440); and terminating the recording of the machine parameters and/or machine modes (step 440).

With respect to step 410, an operator or other personnel associated with motor grader 10 may set one or more machine parameters and/or one or more machine modes of motor grader 10. Setting a machine parameter or machine mode may include providing instructions to move one or more components of motor grader 10 into a desired position. For example, setting a machine parameter may include providing instructions to any controllable component of motor grader 10, such as any one or more of the actuators discussed above in connection with FIGS. 1-3 (e.g. actuators 82 and 124-138 of FIG. 3). The machine parameters may be associated with an individual machine component, or may include the coordination of multiple machine components. For example, machine parameters may include blade lift position, drawbar centershift position, blade sideshift position, and/or blade pitch position, as discussed above.

Similar to the setting of the machine parameters of step 410, one or more modes of the motor grader 10 may be set by the operator or other personnel associated with motor grader 10. A mode of the motor grader 10 may be a defined subset or collection of machine parameters that are associated with a particular operation of the motor grader 10. The modes may be identified or accessed by the motor grader 10, for example through user interfaces 104, and may include a number of selectable values associated with the mode (e.g. on, off, input value, etc.). Modes of motor grader 10 may include, for example, a differential lock mode of the motor grader 10, an auto articulation mode of the motor grader 10, a bounce reduction mode of the motor grader 10, a ride control mode of the motor grader 10, an engine speed of the motor grader, or a desired gear of the drivetrain of the motor grader 10. Any mode provided by the motor grader 10 may be set in accordance with step 410.

The setting of the machine parameters, and/or modes of motor grader 10 can be achieved in any conventional manner, e.g. via operator interfaces 104 (e.g., joysticks, buttons, petals, and/or touch screen displays) of motor grader 10, or may be done remotely. In one example, the operator may input machine parameter settings as well as machine mode settings via the user interfaces 104 by selecting an icon or icons on a touch screen display for the specific machine parameter or mode, i.e. an icon for blade angle, found on a home screen of the user interface 104, inputting the desired blade angle, and the control system 100 will set the blade angle as desired. The machine parameters and/or modes may be stored immediately prior to performing a particular function on the machine, or the machine parameters and/or modes may be stored for later recall by the operator or remote personnel.

In step 420 of FIG. 4, the machine parameters and/or machine modes are stored in association with a particular machine function and machine location on the work site. Motor grader functions may correspond to routine operations of the motor grader 10. Motor grader functions may include, for example, a marking pass, a cutting pass, a shoulder cleanup pass, a ditch backslope pass, or a finish shoulder pass. Similar to the machine modes discussed above, these functions of motor grader 10 may be predefined or preset functions or operations of the machine, and may include one or more automatically enabled machine parameters or modes of the machine. The functions may be identified within the user interface 104, such as on a touch screen of the motor grader 10. Further, the particular functions of the motor grader 10 may be associated with the location of the machine on the work site. Thus, the operator (or remote personnel) may associate the stored machine parameters and/or modes (Step 410) with a particular function of the machine, and associate the function with the location of the machine. The location of the machine may be the current location of the machine, for example, as determined by the location sensor 107. Alternatively, the location may be remote from the current location of the motor grader 10 and selected by the operator or associated personnel, for example, by entering coordinates or selecting the location on an electronic map of the worksite, such as through a user interface 104. The stored machine parameters and/or mode of motor grader 10 will thus be associated with a desired function of the machine and a location of the motor grader 10 on the job site. This stored information is shown in memory 109 of FIG. 3. The identification and storing of machine functions with associated machine parameters, machine modes, and locations be done immediately prior to performing the particular function on the machine, or the associated function, machine parameters, modes, and location data may be stored for later recall by the operator or remote personnel. For example, the data may be stored or setup in controller 102 of motor grader 10 before operation of the machine for the day, or prior to any operation on the work site as part of a work site setup.

In a step 430, the operator or remote personnel initiates automatic recording of a particular machine function. For example, once the operator has set the machine parameters, machine modes, function, and associated machine location (Steps 410, 420), the operator may operate the motor grade 10 to perform the machine function. The controller 102 may then store or record in memory 109 the information or data from the above-discussed components of motor grader 10 during the operation of the machine function, thus recording changes to machine parameters and modes of the motor grader 10 during the particular machine function. The recording will be associated with the changing location of the machine, for example, as determined by location sensor 107. The operator may initiate the recording of the machine function by selecting this option setting from the user interface 104, and this automatic recording will continue until this setting is terminated (Step 450). Alternatively, the recording of the machine function may be automatically determined by the controller, such as through a process of recognizing the performance of the function and initiating recording.

In a step 440, the motor grader 10 performs the particular function on the work site. The operator may advance motor grader 10 as desired along a path through the work site by using the control system 100, changing machine parameters and/or modes as necessary to meet the requirements of the terrain and the specific job. The location of the motor grader 10 may be automatically updated into the memory 107 and associated with the corresponding machine parameters and modes.

In a step 450, automatic recording of the machine parameters, machine modes, and machine location for the particular function may be terminated. The operator may terminate the recording, for example, through the user interface 104. Once the recording of the function is terminated, controller 102 stores the termination location of machine function in memory 109.

Once the machine parameters and/or modes have been recorded for a particular machine location and function in accordance with method 400, the method of FIG. 5 can be used by an operator or remote personnel to recall a function from memory 109 (including the associated set and recorded parameters, modes and locations) to automatically configure the machine to perform the function and/or guide or automatically or semi-automatically perform the machine function. For example the method of FIG. 5 may include moving the motor grader 10 to a particular location associated with a machine function (Step 510), the operator or remote personnel may then select a machine function (Step 520), the selecting of the function may automatically initiate the moving of the various actuators and components of motor grader 10 to achieve the stored machine parameters and modes in accordance with the recorded machine parameters and modes of method 400 associated with the machine location. Method 500 may also include operating the motor grader 10 in accordance with the recorded machine function (Step 540), and automatically updating any machine parameters or modes associated with a particular location based on operator or location modifications during the operation of the machine functions.

In step 510, the operator moves the motor grader 10 to a location on the work site. This positioning of the motor grader 10 to a location may occur after a brief break in work, at the beginning of the work day, or at any point during work at a job site. As discussed above, the operator moves the motor grader 10 through use of the user interfaces 104 (e.g. joysticks, petals, displays, etc.), and location sensor 107 tracks the location of the motor grader 10.

The selection of a machine function (Step 520) can be done by the machine operator or remote personnel, and may be initiated in any appropriate manner, e.g., user interface 104. As noted above, the machine function can include, for example, a marking pass, a cutting pass, a shoulder cleanup pass, a ditch backslope pass, or a finish shoulder pass. Automatically in response to the selection of a machine function, the machine parameters and modes of the machine may be initiated based on the stored settings in memory 107 based on the current location of the motor grader 10 (Step 530). Alternatively, control system 100 may be configured to require the operator or remote personnel to approve or accept the adoption of the stored machine parameters and/or modes. This can be done through, for example, user interface 104. The initiation of the machine parameters and/or modes may result in various components of the motor grader 10 being actuated, engaged, and/or moved to positions for operation of the function at that machine location.

Once the components of the motor grader 10 are configured in accordance with the stored machine parameters and/or modes of the particular function and location, the motor grader 10 is ready for operation through the work site (Step 540). As noted above, the operation of the function may be fully automated or autonomous in accordance with the recorded function, or partially automated in accordance with certain aspects of the stored recording of the function (steps 430-450). When operating the motor grader 10 in accordance with the recorded function, control system 100 may automatically update the machine parameters and/or modes of the machine based on a change in location of the grading machine. For example, the machine parameters associated with the position of the grading blade 16 may be updated throughout the motor grader function in accordance with the stored values and location of the motor grader.

Alternatively, the recorded machine parameters and/or modes may be used merely to set up the machine prior to the function, whereas the operator controls the function independent of the stored recording of the function. While the machine is operating the function automatically or semi-automatically, the stored machine parameters and/or modes of the function may be updated based on the change in location of the machine, and based on changes to the recorded parameters and modes (Step 550). For example, the operator of the motor grader may make manual changes to the machine parameters or modes that deviate from the stored parameters and modes for a particular function and machine location. These manual changes may be recorded/stored to make an updated recording of the function and location-based machine parameters and/or modes (Step 550). This updating of the machine parameters and modes may be done automatically, or alternatively, only when requested by the operator or remote personnel, for example, by one or more use interfaces 104. This can be achieved, for example, with the recording function discussed above with steps 430-450. While the components of the motor grader 10 may be automatically adjusted by the controller 102 in accordance with the recorded function and location of the motor grader 10, and associated stored/recorded machine parameters and/or modes, the machine operator or remote personnel may nonetheless take over partial or full control of the motor grader 10 at any point in the machine operation.

INDUSTRIAL APPLICABILITY

The disclosed aspects of motor grader 10 may be used in any grading or sculpting machine to assist in positioning of one or more of the components of the machine in accordance with a desired function and location on a work site.

The method 400 of storing machine parameters based on function and location, and the method 500 of recalling a stored function based on location, may facilitate efficient operation of motor grader 10, and provide for a more productive work site. With so many degrees of freedom and different machine parameters, the motor grader is a complex machine that is difficult for operators to learn how to operate, and to learn how to position for optimum efficiency and productivity. Through the use of the two methods illustrated above, an operator is able to easily recall stored settings from the same work site in association with the location of the motor grader 10 on the work site, and to automate operation of the motor grader with greater efficiency. For example, an inexperienced motor grader operator increase efficiency or productivity by using the stored functions to mimic the operation of a more experienced or efficient operator. The stored machine parameters and/or modes and associated function recording may also provide on-site training for the less experienced operator. The stored location-based settings can also assist in resuming interrupted jobs or functions, and may assist in the transition of operators mid-job or function. For the experienced operator, the use of the recorded function may relieve the operator of certain operational tasks, provide for better consistency of the operation of the function, and may provide for an optimizing the operation of the function through the updating process.

The aspects disclosed herein may also help an operator to accurately and quickly maneuver motor grader 10 to perform various functions at the required locations. Moreover, automatically positioning components of the motor grader 10, such as the blade 16, drawbar 26, and circle 46 in the stored positions may help ensure that blade 16 is positioned at an appropriate blade tilt, blade angle, blade pitch, sideshift position, etc., which may reduce wear on cutting edge 36, promote material rolling in a spreading operation, efficiently penetrate or cut material in grading or cutting operations, accurately cast the spread, graded, or cut material, etc. Reducing wear on cutting edge 36 and accurately positioning blade 16, drawbar 26, and circle 46 may increase the lifetime of blade 16 and other components of motor grader 10, while also allowing an operator to efficiently perform the various functions discussed herein.

It will be apparent to those skilled in the art that various modifications and variations can be made to the disclosed machine without departing from the scope of the disclosure. For example, while the operation of the motor grader is discussed above with respect to an operator, it is understood that one or more of the operator steps discussed above may be done remotely, for example by a remote operator or associated personnel. In addition, the location-based function settings and/or recordings may be saved in association with multiple operators, so that a particular operator may retrieve their own settings or recorded motor grader functions. Further, while the disclosure above discusses preset functions, it is understood that the stored settings and recordings may be saved in accordance with any operation of the motor grader, and is not limited to preset or predefined functions of the motor grader 10. Other embodiments of the machine will be apparent to those skilled in the art from consideration of the specification and practice of the control system for a grading machine disclosed herein. It is intended that the specification and examples be considered as exemplary only, with a true scope of the disclosure being indicated by the following claims and their equivalents.

What is claimed is:

1. A grading machine, comprising
a machine body;
a grading blade; and
a control system configured to:
determine a location of the grading machine;
automatically select a grading machine function associated with the determined location of the grading machine;
automatically set at least one machine parameter of the grading blade based on the automatically selected grading machine function and the determined location of the grading machine;
automatically set a mode of operation of the grading machine based on the automatically selected grading machine function and the determined location of the grading machine, the mode of operation including a setting other than a setting for the grading blade;
automatically update the at least one machine parameter based on a change in the location of the grading machine during performance of the grading machine function; and
automatically update the setting of the mode of operation based on the change in the location of the grading machine during performance of the grading machine function.

2. The grading machine of claim 1, wherein the setting of the mode of operation includes a setting for at least one of differential lock, auto articulation, bounce reduction, ride control, engine speed, or a gear of a drivetrain of the grading machine.

3. The grading machine of claim 1, wherein the automatically setting of the at least one machine parameter includes retrieving a stored setting associated with the determined location.

4. The grading machine of claim 1, wherein the at least one machine parameter of the grading blade includes blade lift position, drawbar centershift position, blade sideshift position, or blade pitch position.

5. The grading machine of claim 1, wherein the determined location of the grading machine is based on machine location data received by the grading machine.

6. The grading machine of claim 1, wherein the grading machine function includes one of marking pass, cutting pass, shoulder cleanup pass, ditch backslope pass, or finish shoulder pass.

7. The machine of claim 1, wherein the mode of operation includes at least one of differential lock, auto articulation, bounce reduction, or ride control of the machine.

8. A method of operating a machine having a machine body and a grading blade, the method comprising:
determining a location of the machine;
automatically selecting a machine function associated with the determined location of the machine;
automatically setting at least one machine parameter of the grading blade based on the automatically selected machine function and a stored machine parameter of the grading blade associated with the determined location of the machine;
automatically setting a mode of operation of the machine based on the automatically selected machine function and the determined location of the machine, wherein the mode of operation includes at least one of differential lock, bounce reduction, or ride control;
operating the machine with the automatically set at least one machine parameter of the grading blade and the automatically set mode of operation;
automatically updating the setting of the at least one machine parameter based on a change in the location of the machine during performance of the machine function; and
automatically updating the setting of the mode of operation based on the change in the location of the machine during performance of the machine function.

9. The method of claim 8, wherein the automatically updating of the setting of the at least one machine parameter is in accordance with a previously recorded operation of the machine.

10. The method of claim 8, wherein the at least one machine parameter of the grading blade includes blade lift position, drawbar centershift position, blade sideshift position, or blade pitch position.

11. The method of claim 8, wherein the determining of the location of the machine is based on machine location data received by the machine.

12. The method of claim 8, wherein the machine function includes one of marking pass, cutting pass, shoulder cleanup pass, ditch backslope pass, or finish shoulder pass.

13. A method of operating a machine having a machine body and a grading blade, the method comprising:
determining a location of the machine;
automatically selecting a machine function associated with the determined location of the machine;
storing at least one machine parameter of the grading blade in association with the location of the machine;
storing at least one mode of operation in association with the location of the machine, the at least one mode of operation including a setting other than a setting for the position of the grading blade;
automatically setting at least one machine parameter of the grading blade based on the stored at least one machine parameter of the grading blade, the automatically selected machine function, and the determined location of the machine;
automatically setting the at least one mode of operation based on the stored at least one mode of operation, the automatically selected machine function, and the determined location of the machine;
operating the machine with the automatically set at least one machine parameter of the grading blade and the automatically set at least one mode of operation; and
automatically updating the at least one machine parameter based on a change in location of the machine during performance of the machine function.

14. The method of claim 13, further including initiating a recording of the at least one machine parameter of the grading blade during operation of the machine.

15. The method of claim 13, wherein the at least one mode of operation includes at least one of differential lock, auto articulation, bounce reduction, ride control, engine speed, or a gear of a drivetrain of the machine.

16. The method of claim 13, further including initiating a recording of the at least one mode of operation during operation of the machine.

17. The method of claim 13, further including automatically updating the setting of the mode of operation based on the change in location of the machine during performance of the machine function.

* * * * *